US007308776B2

(12) United States Patent
Ray et al.

(10) Patent No.: US 7,308,776 B2
(45) Date of Patent: Dec. 18, 2007

(54) POLE ANCHOR FOOTING SYSTEM

(76) Inventors: Robert H. Ray, P.O. Box 155, Igo, CA (US) 96047; Patricia L. Shores, P.O. Box 155, Igo, CA (US) 96047

( * ) Notice: Subject to any disclaimer, the term of this patent is extended or adjusted under 35 U.S.C. 154(b) by 52 days.

(21) Appl. No.: 10/646,021

(22) Filed: Aug. 22, 2003

(65) Prior Publication Data

US 2004/0194400 A1 Oct. 7, 2004

Related U.S. Application Data

(60) Provisional application No. 60/460,647, filed on Apr. 4, 2003.

(51) Int. Cl.
*E02D 27/42* (2006.01)

(52) U.S. Cl. ..... 52/169.9; 52/170; 52/155; 52/156; 52/298

(58) Field of Classification Search ..... 52/94, 52/155–156, 166, 169.1, 169.9, 169.13, 170, 52/737.4, 737.5, 169.17, 292, 294, 298, 737.1; 40/607.01, 607.02, 607.03, 607.04, 607.05, 40/608, 611.01, 611.05, 611.06, 611.07; 256/DIG. 5, 65.02, 65.14
See application file for complete search history.

(56) References Cited

U.S. PATENT DOCUMENTS

| | | | | | |
|---|---|---|---|---|---|
| 76,515 | A | * | 4/1868 | Patton | 52/298 |
| 1,164,909 | A | * | 12/1915 | Auberlin | 40/606.14 |
| 1,307,655 | A | * | 6/1919 | Brown | 40/607.04 |
| 1,605,639 | A | * | 11/1926 | Barrick | 52/298 |
| 1,647,925 | A | * | 11/1927 | May | 52/223.5 |
| 1,794,467 | A | * | 3/1931 | Lucas | 362/152 |
| 1,805,731 | A | * | 5/1931 | Beckwith | 52/298 |
| 1,891,736 | A | * | 12/1932 | Sporn | 52/170 |
| 2,240,016 | A | * | 4/1941 | Pinney | 562/296 |
| 2,374,624 | A | * | 4/1945 | Schwendt | 52/223.5 |
| 2,409,076 | A | * | 10/1946 | Steinberger et al. | 40/606.15 |
| 2,819,547 | A | * | 1/1958 | Clements, Jr. | 40/612 |
| 3,305,990 | A | * | 2/1967 | Hageby | 52/298 |
| 3,421,473 | A | * | 1/1969 | Weichenrieder | 116/63 R |
| 3,572,223 | A | * | 3/1971 | Vierregger | 52/296 |
| 3,653,169 | A | * | 4/1972 | Jenner | 52/298 |
| 4,105,350 | A | * | 8/1978 | O'Donnell | 403/220 |
| 4,133,154 | A | * | 1/1979 | Ruzicka | 52/298 |
| 4,200,906 | A | * | 4/1980 | Santilli | 362/431 |
| 4,262,439 | A | * | 4/1981 | Dinan et al. | 40/606.02 |
| 4,329,800 | A | * | 5/1982 | Shuman | 40/606.14 |

(Continued)

FOREIGN PATENT DOCUMENTS

| | | | |
|---|---|---|---|
| JP | 57036226 | A * | 2/1982 |

(Continued)

*Primary Examiner*—Jeanette Chapman
(74) *Attorney, Agent, or Firm*—Donald R. Boys; Central Coast Patent Agency

(57) ABSTRACT

A pole anchor footing system for effectively supporting a post structure within a ground surface. The pole anchor footing system includes a resilient body having a neck portion and a base portion, and an elongate member extending into the body from an upper end of the body. The body is securely positionable within a ground surface. The neck portion receives a coupler that mechanically connects a post to the body. The base portion has an upwardly tapered structure with the lower end having a broad structure. A plurality of engaging members may extend outwardly from the body for providing additional gripping while positioned within the ground surface.

5 Claims, 8 Drawing Sheets

U.S. PATENT DOCUMENTS 4,329,801 A * 5/1982 Clausen ..... 40/607.03
4,875,808 A * 10/1989 Kellison ..... 405/244
5,143,472 A * 9/1992 Reed et al. ..... 403/230
5,246,754 A 9/1993 Miller ..... 428/36.91
5,271,203 A * 12/1993 Nagle ..... 52/721.4
5,320,152 A 6/1994 Ganley ..... 144/352
5,340,630 A 8/1994 Tripp ..... 428/54
5,468,436 A 11/1995 Kirtland ..... 264/112
5,472,750 A 12/1995 Miller ..... 428/2
5,485,700 A * 1/1996 Van Vranken ..... 52/40
5,535,555 A * 7/1996 Boyd et al. ..... 52/99
5,625,988 A * 5/1997 Killick ..... 52/298
5,675,956 A 10/1997 Nevin ..... 52/726.1
5,752,349 A * 5/1998 Fitzsimmons et al. ..... 52/165
5,794,395 A * 8/1998 Reed ..... 52/298
5,890,333 A * 4/1999 Boroviak ..... 52/292
5,901,525 A * 5/1999 Doeringer et al. ..... 52/736.4
6,061,990 A * 5/2000 McMahon ..... 52/677
6,102,627 A * 8/2000 Ueda et al. ..... 405/255
6,322,863 B1 11/2001 Kubicky ..... 428/34.5
6,324,800 B1 * 12/2001 Valentz et al. ..... 52/298
6,372,069 B1 4/2002 Walls ..... 156/95
6,401,411 B1 * 6/2002 Maglio, Jr. ..... 52/297
6,422,783 B1 7/2002 Jordan ..... 404/9
6,457,895 B1 10/2002 Salman ..... 403/2
6,527,481 B1 * 3/2003 Mazzo et al. ..... 405/231
6,729,089 B1 * 5/2004 Spragg ..... 52/296
6,854,934 B2 * 2/2005 Yamane et al. ..... 405/255
2003/0072904 A1 4/2003 Hansen ..... 428/36.8

FOREIGN PATENT DOCUMENTS

JP 8239812 9/1996

* cited by examiner

POLE ANCHOR FOOTING SYSTEM

CROSS REFERENCE TO RELATED APPLICATIONS

I hereby claim benefit under Title 35, United States Code, Section 119(e) of U.S. provisional patent application Ser. No. 60/460,647 filed Apr. 4, 2003. The 60/460,647 application is currently pending. The 60/460,647 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to post supports and more specifically it relates to a pole anchor footing system for effectively supporting a post structure within a ground surface.

2. Description of the Related Art

Post structures have been in use for years. Conventional posts are typically comprised of wood, metal or other structure that is directly inserted into the ground surface. Regardless of the material utilized to construct the post, the post typically has a uniform cross sectional shape (e.g. square, rectangular, circular) and size.

The main problem with wood posts is that they are treated with potentially toxic and hazardous chemicals that can enter the ground. A further problem with wood and metal posts is that they can be relatively expensive to construct with sufficient length to be inserted into the ground surface. Another problem with wood and metal posts is that they deteriorate over extended periods of time. A further problem with wood and metal posts is that they tend to "climb" upwardly out of the ground and twist within the ground particularly in unstable ground surfaces (e.g. sand, wet, soft, etc.). Another problem with wood and metal posts is that they are relatively rigid providing little deflection when the post encounters above-ground forces such as wind, snow and other forces.

While these devices may be suitable for the particular purpose to which they address, they are not as suitable for effectively supporting a post structure within a ground surface. Conventional posts do not efficiently and effectively support themselves within various ground surface conditions.

In these respects, the pole anchor footing system according to the present invention substantially departs from the conventional concepts and designs of the prior art, and in so doing provides an apparatus primarily developed for the purpose of effectively supporting a post structure within a ground surface.

BRIEF SUMMARY OF THE INVENTION

In view of the foregoing disadvantages inherent in the known types of post structures now present in the prior art, the present invention provides a new pole anchor footing system construction wherein the same can be utilized for effectively supporting a post structure within a ground surface.

The general purpose of the present invention, which will be described subsequently in greater detail, is to provide a new pole anchor footing system that has many of the advantages of the post structures mentioned heretofore and many novel features that result in a new pole anchor footing system which is not anticipated, rendered obvious, suggested, or even implied by any of the prior art post structures, either alone or in any combination thereof.

To attain this, the present invention generally comprises a resilient body having a neck portion and a base portion, and an elongate member extending into the body from an upper end of the body. The body is securely positionable within a ground surface. The neck portion receives a coupler that mechanically connects a post to the body. The base portion has an upwardly tapered structure with the lower end having a broad structure. A plurality of engaging members may extend outwardly from the body for providing additional gripping while positioned within the ground surface.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a pole anchor footing system that will overcome the shortcomings of the prior art devices.

A second object is to provide a pole anchor footing system for effectively supporting a post structure within a ground surface.

Another object is to provide a pole anchor footing system that is environmentally safe.

An additional object is to provide a pole anchor footing system that may be subjected to significant forces without damage to the footing structure within the ground.

Another object is to provide a pole anchor footing system that is capable of flexing when encountering an aboveground force.

A further object is to provide a pole anchor footing system that is not susceptible to climbing or twisting within a ground surface.

An additional object is to provide a pole anchor footing system that may be utilized in conjunction with various post coupler systems for supporting an aboveground post.

Another object is to provide a pole anchor footing system that may be utilized within various types of ground surfaces such as but not limited to sand, wet, soft and the like.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
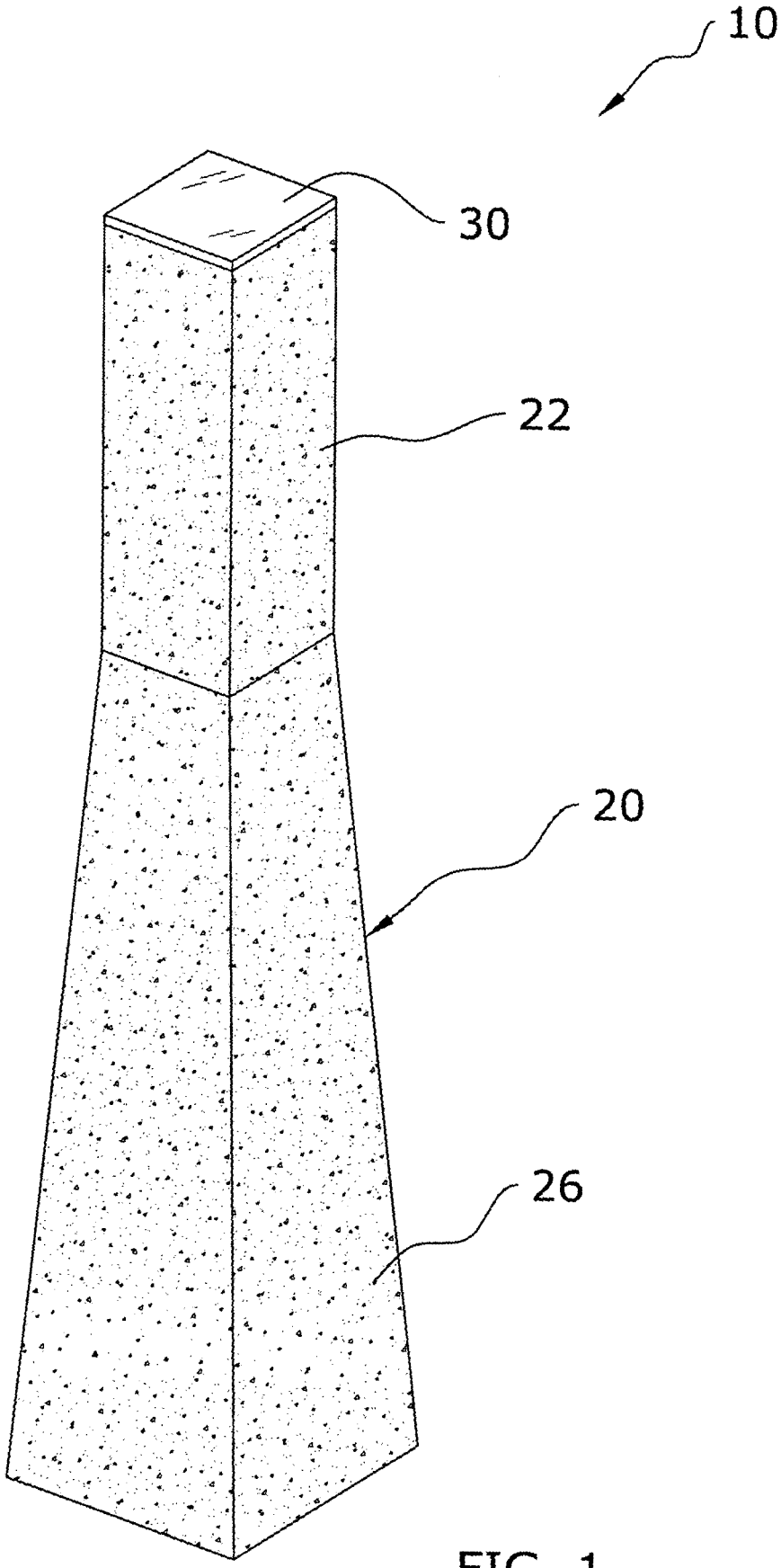
FIG. 1 is an upper perspective view of the present invention.
Figure 2:
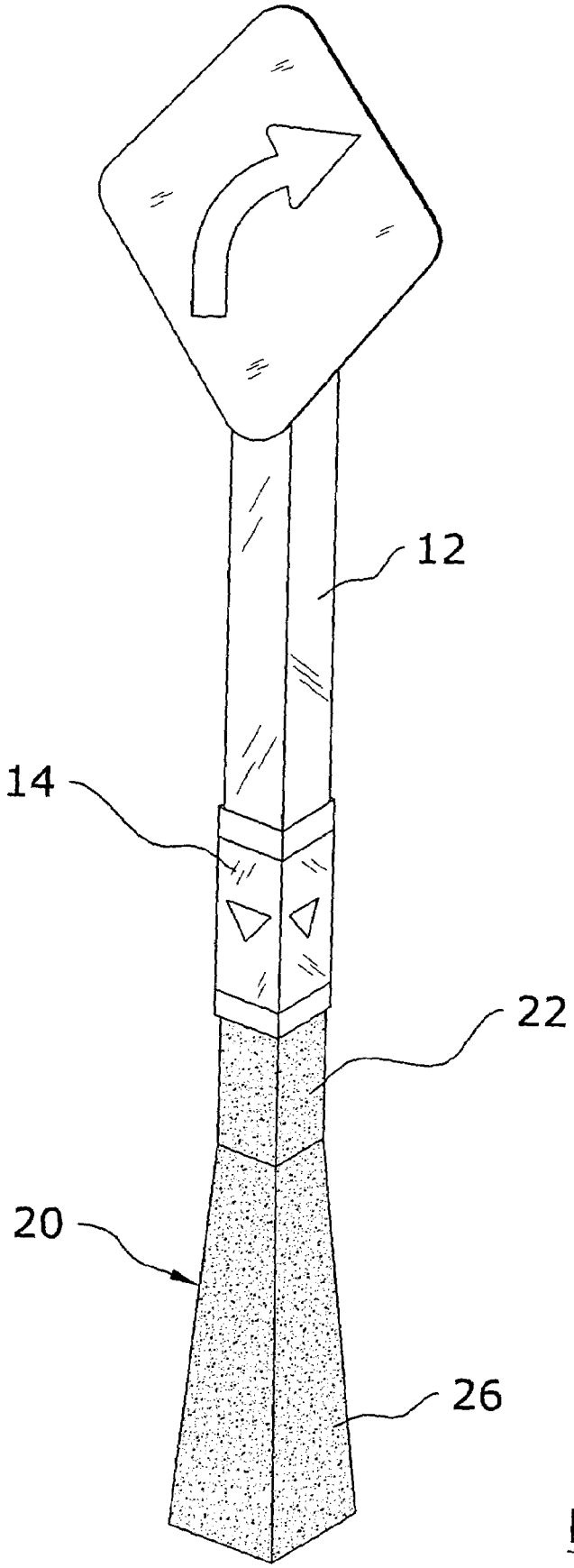
FIG. 2 is an upper perspective view of the present invention with a post attached.

Turning now descriptively to the drawings, in which similar reference characters denote similar elements throughout the several views, FIGS. 1 through 8 illustrate a pole anchor footing system 10, which comprises a resilient body 20 having a neck portion 22 and a base portion 26, and an elongate member 40 extending into the body 20 from an upper end 24 of the body 20. The body 20 is securely positionable within a ground surface. The neck portion 22 receives a coupler 14 that mechanically connects a post 12 to the body 20. The base portion 26 has an upwardly tapered structure with the lower end having a broad structure. A plurality of engaging members 28 may extend outwardly from the body 20 for providing additional gripping while positioned within the ground surface.

B. Resilient Body

Figure 3:
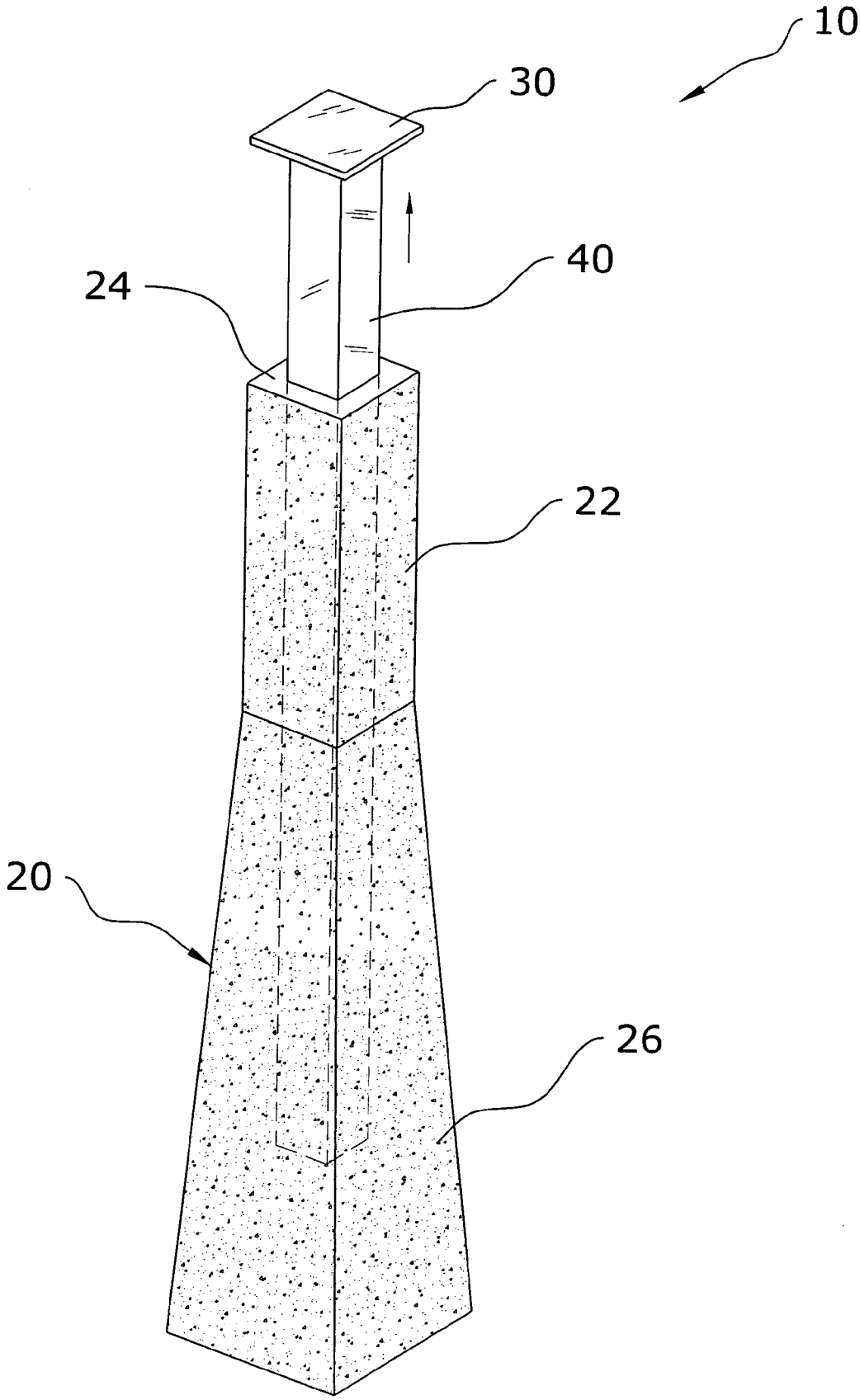
FIG. 3 is an exploded upper perspective view of the present invention.
Figure 4:
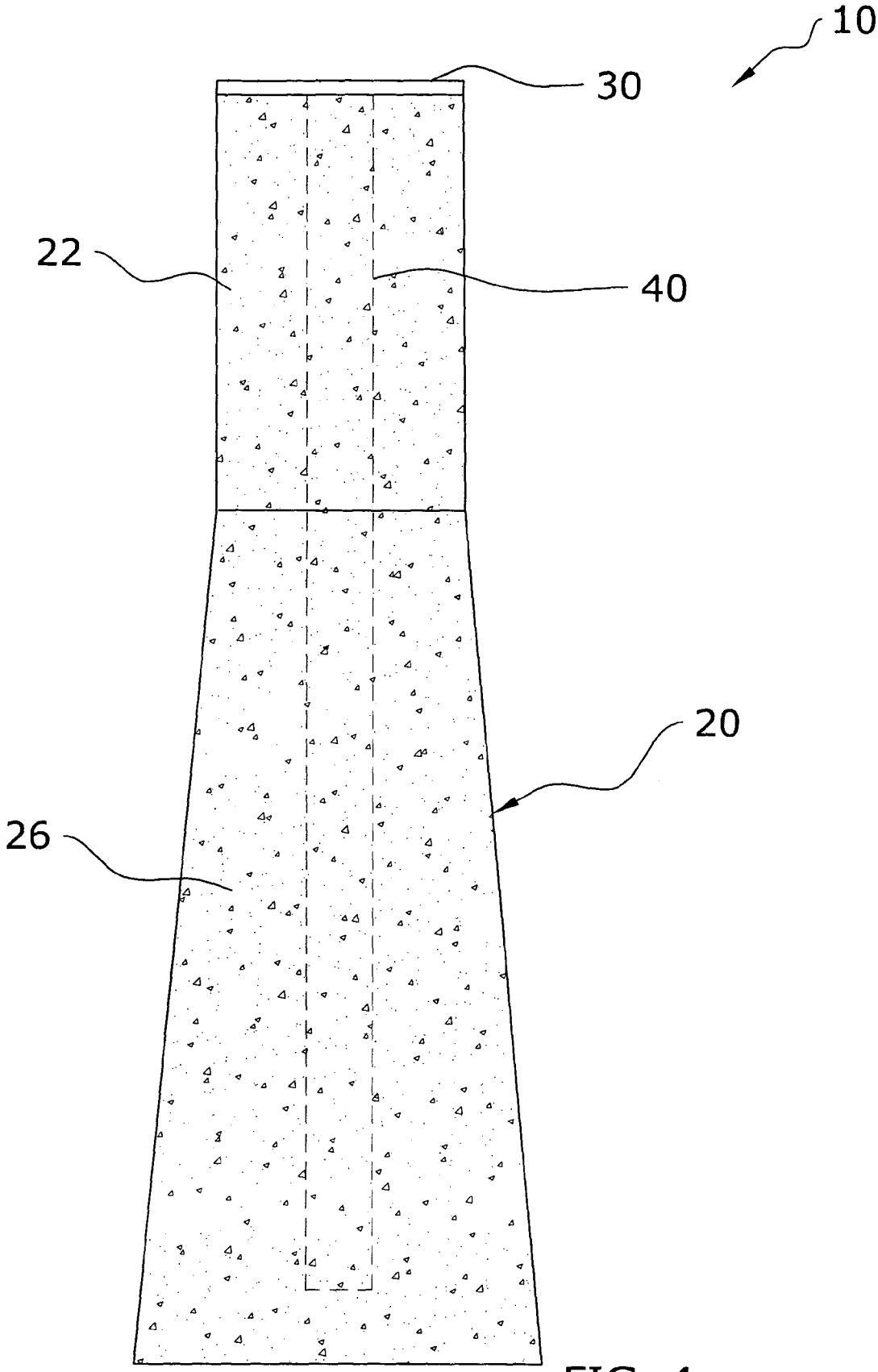
FIG. 4 is a side view of the present invention.
Figure 5:
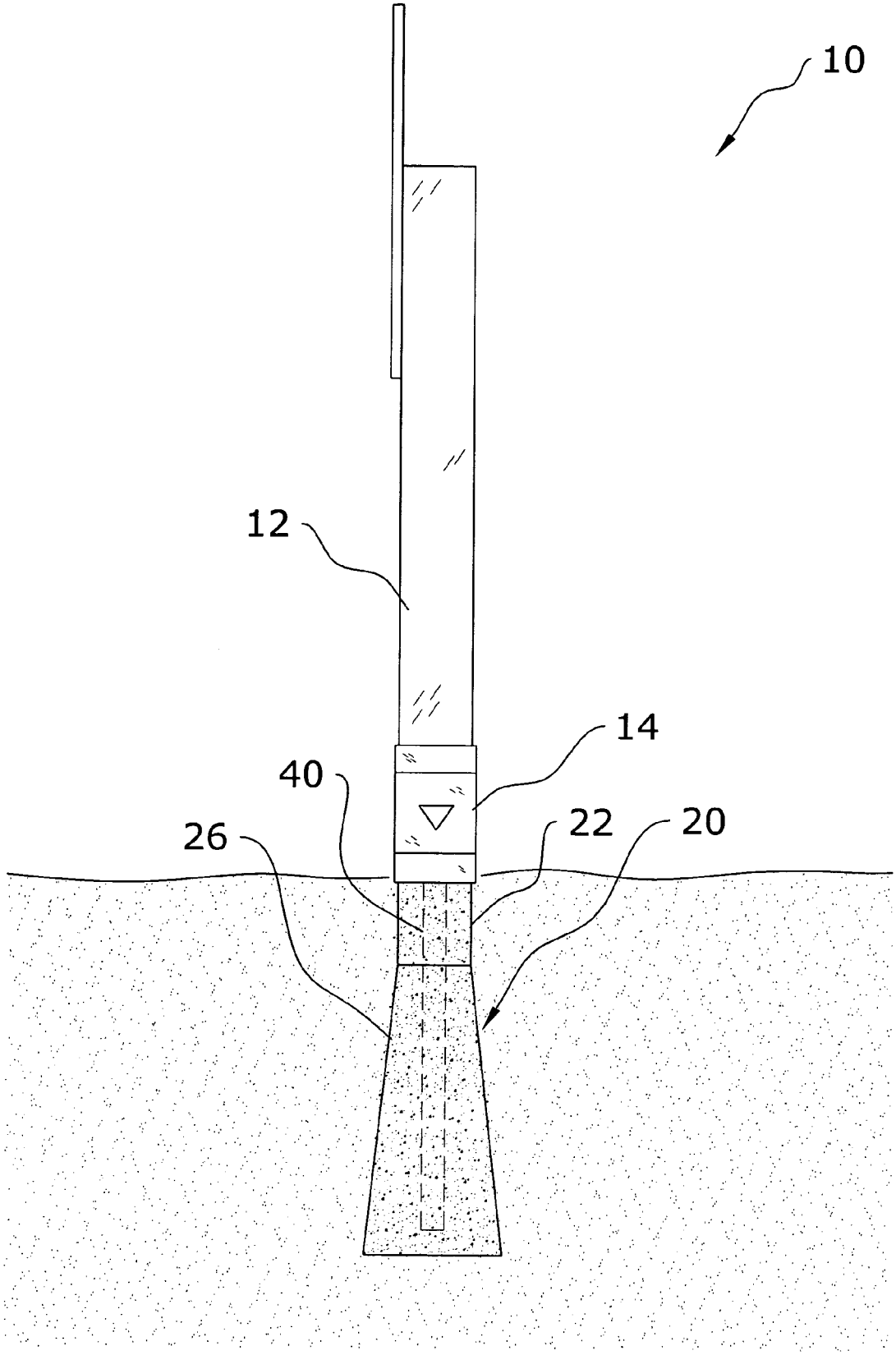
FIG. 5 is a side view of the present invention with a post attached with the present invention positioned within a ground surface.

FIGS. 1 through 5 best illustrate the resilient body 20. The body 20 is positionable within a ground surface as shown in FIG. 5 of the drawings. The body 20 is preferably comprised of a resilient and elastic material such as but not limited to rubber, recycle rubber and the like. The body 20 is preferably comprised of a solid structure, however various other structures may be utilized to construct the body 20 that are not solid.

The body 20 may have various flexing capabilities depending upon the desired application. The flexing characteristics of the body 20 may be varied by utilizing different materials, different particle sizes, reinforcements, different binders and different molding pressures.

The body 20 preferably has a non-circular cross section to reduce twisting within the ground surface such as but not limited to square, rectangular, triangular, polygonal, oval and the like. The body 20 preferably has a height sufficient to be buried within the ground surface while allowing the attachment of the post 12 as shown in FIG. 5 of the drawings.

As best shown in FIGS. 1 and 4 of the drawings, the body 20 has a neck portion 22 and a base portion 26 supporting the neck portion 22. The base portion 26 has an upwardly tapered structure as best shown in FIG. 4 of the drawings. More particularly, the base portion 26 has a lower broad end and an upper portion opposite of the lower broad end as shown in FIG. 4 of the drawings. The lower broad end of the base portion 26 prevents "climbing" of the body 20 when the post 12 encounters above-ground forces such as wind, snow, vehicles and the like.

As shown in FIGS. 1 and 4 of the drawings, the base portion 26 preferably has a plurality of polygonal sides which may have various shapes and sizes. The base portion 26 preferably has at least four sides and a square lower end as further shown in FIGS. 1 and 4 of the drawings. However, the drawings should not limit the size, shape and structure of the body 20 as various other structures may be utilized.

As shown in FIGS. 1 and 4 of the drawings, the base portion 26 transitions into the neck portion 22. The neck portion 22 has a consistent cross section as best illustrated in FIG. 4 of the drawings. The neck portion 22 is connectable to a post 12 either directly or by a coupler 14.

An exemplary coupler 14 that may be utilized with the present invention is illustrated in U.S. Pat. No. 5,535,555. The post 12 may be comprised of any conventional post 12 structure that supports an object such as a sign and the like.

C. Engaging Members

Figure 7:
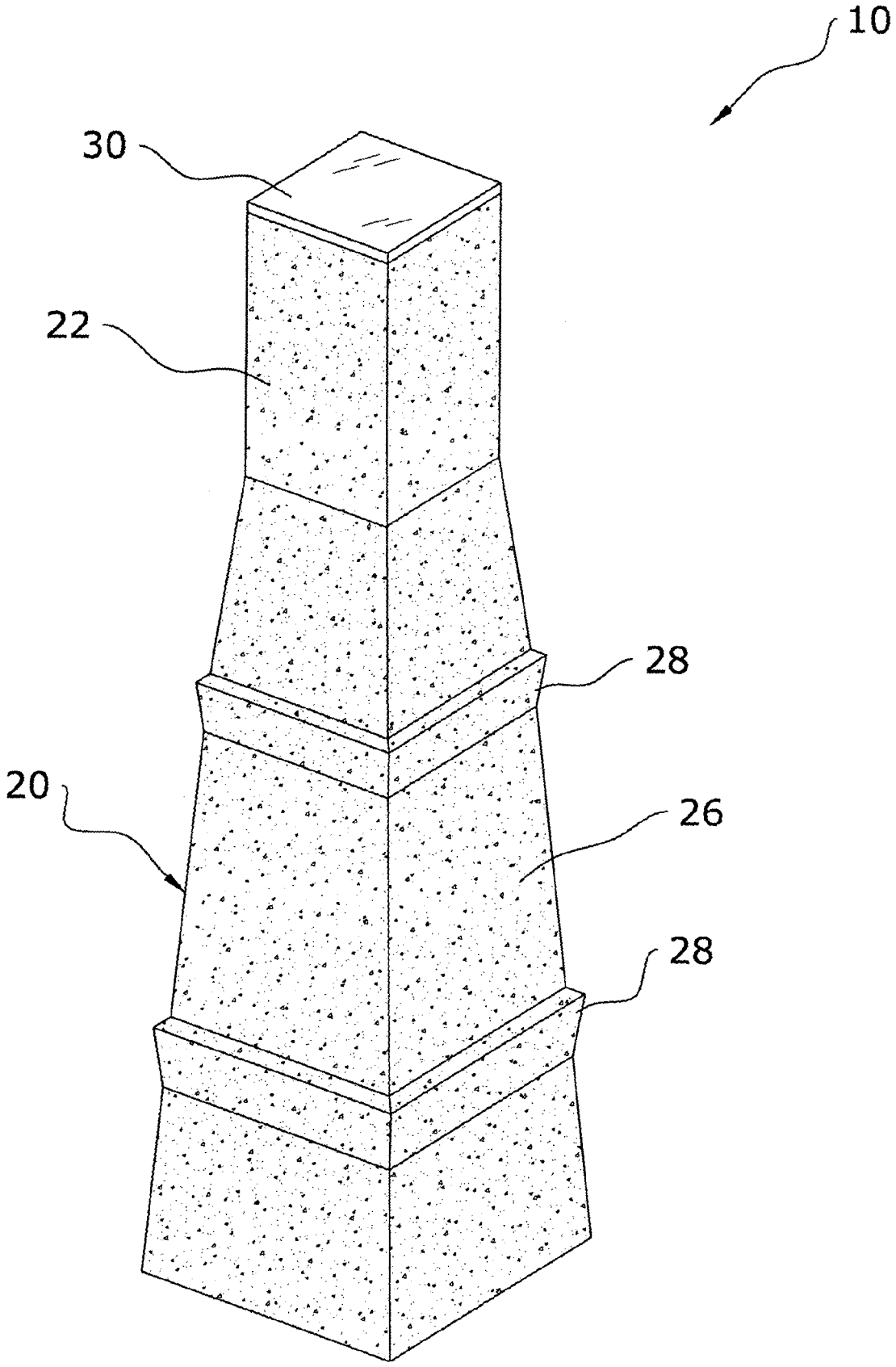
FIG. 7 is an upper perspective view of an alternative embodiment of the present invention.
Figure 8:
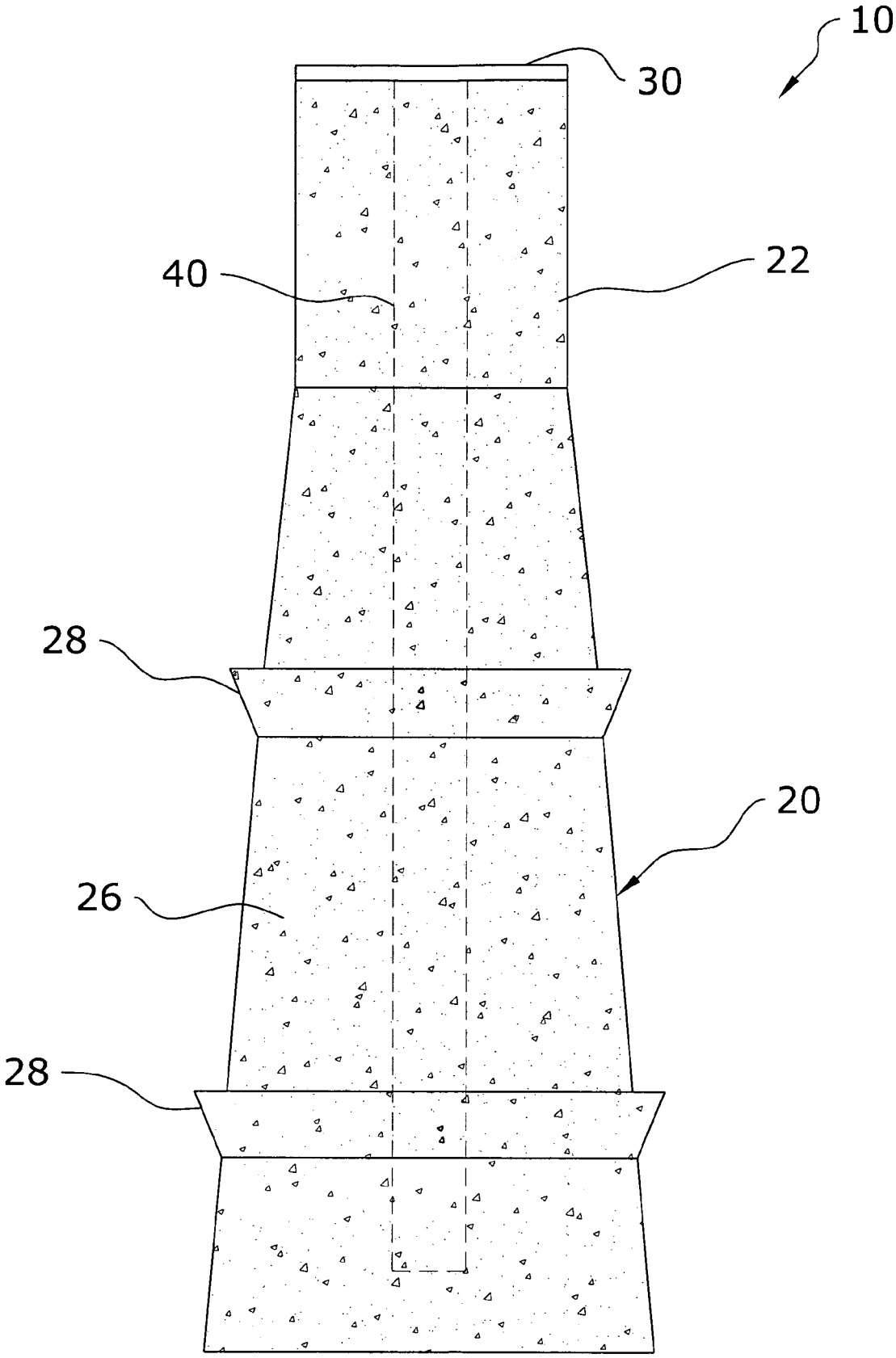
FIG. 8 is a side view of the alternative embodiment of the present invention.

One or more engaging members 28 may extend outwardly from the body 20 as shown in FIGS. 7 and 8 of the drawings. The engaging members 28 are preferably a flanged structure that surround the perimeter of the base portion 26. The engaging members 28 may have various shapes and sizes capable of limiting the climbing of the body 20 when the post 12 experiences significant forces.

D. Elongate Member

The elongate member 40 extends longitudinally within the body 20 from an upper end 24 of the body 20 as shown in FIGS. 3 through 6*b* of the drawings. The elongate member 40 is comprised of an elongate rigid structure that may be positioned within an aperture within the body 20 or molded directly within the body 20. The elongate member 40 provides additional support to the body 20 to support a post 12.

Figure 6A:
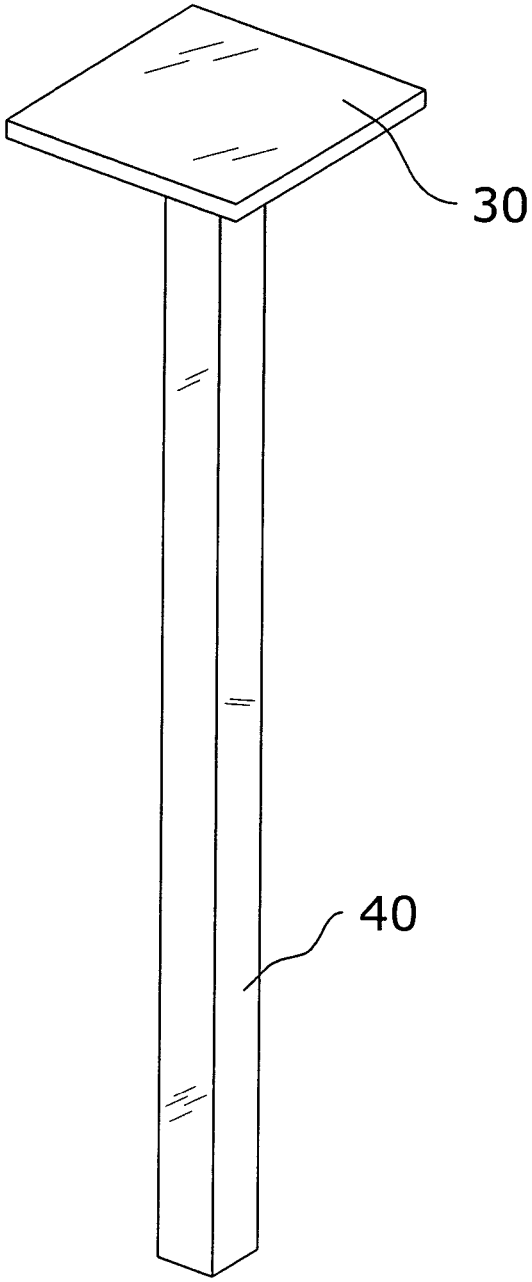
FIG. 6*a* is an upper perspective of an exemplary elongate member and cap member.
Figure 6B:
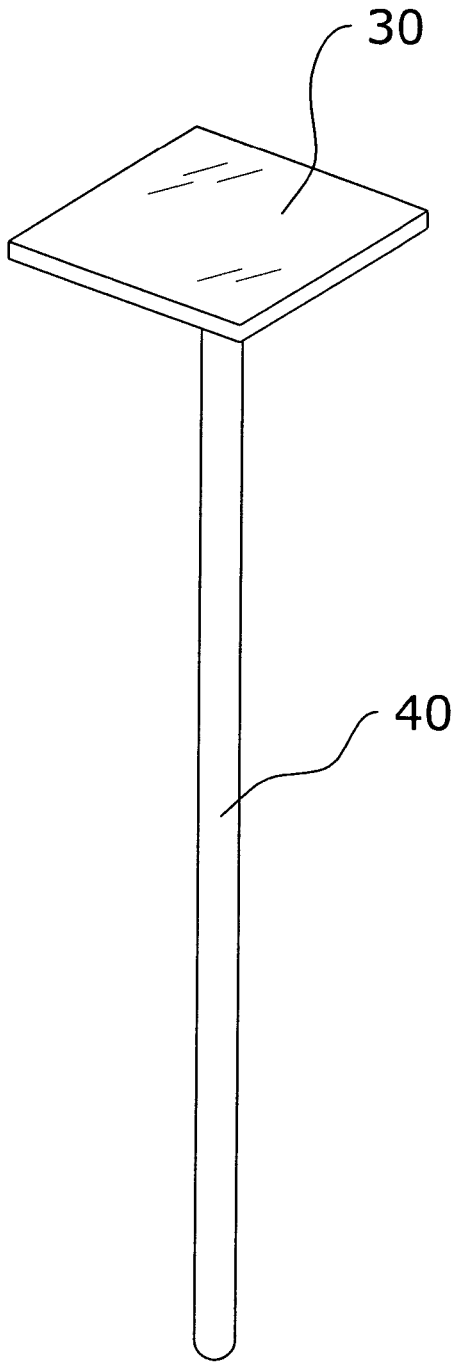
FIG. 6*b* is an upper perspective view of a second exemplary elongate member and cap member.

FIG. 6*a* illustrates a rectangular cross section and FIG. 6*b* illustrates a circular cross section. Various other shapes, lengths and structures may be utilized to construct the elongate member 40 other than illustrated in the drawings. The elongate member 40 may be tubular, solid and the like.

A cap member 30 is preferably attached to the elongate member 40 adjacent to the upper end 24 of the body 20. The cap member 30 is preferably comprised of a flat structure transversely attached to an end of the elongate member 40. The cap member 30 may include mounting apertures and other mounting structures for attaching a post 12 directly to the same. The cap member 30 preferably has a cross section and size similar to the upper end 24 of the body 20 as best shown in FIGS. 1 and 3 of the drawings.

E. Operation

In use, the user excavates a hole within the ground surface capable of receiving the body 20. The user then positions the body 20 within the hole and then fills the hole about the body 20. The post 12 is attached to the neck portion 22 of the body 20 by a coupler 14 or other attachment structure. When a force such as wind, snow, rain, vehicle, bicycle or the like applies a force upon the post 12, the body 20 flexes accordingly to absorb the initial impact of the force thereby reducing damage to the post 12 and body 20. The elongate member 40 within the body 20 moves within the body 20 according to the forces applied to the post 12. The tapered base portion 26 prevents the body 20 from climbing and the plurality of sides prevent the body 20 from twisting within the ground surface. The engaging members 28 provide additional support with respect to potential climbing of the body 20 when encountering forces. If the post 12 becomes damaged, the post 12 may simply be removed from the body 20 without requiring unearthing the body 20 and then attaching a new post 12 to the body 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A post anchor footing, comprising:

a body of resilient and elastic rubber-like material, having an upper portion contiguous with a lower portion, and an upper end and a lower end when disposed vertically, the upper portion having a square cross-section of constant area, and the lower portion forming a truncated pyramid with four sides sloping inward from the lower end to a juncture with the upper portion; and an elongate member extending into the body from said upper end of the body;

wherein the body, buried below ground with the upper end exposed, provides a resilient and stable anchor for a post or pole securely fastened to the elongate member at the upper end of the body, the elastic and resilient body allowing movement of the post or pole without dislodging the body from the ground, and the square cross section reduces twisting within the ground.

2. The post anchor footing of claim 1, wherein the resilient and elastic rubber-like material is one of rubber or recycled rubber material.

3. The system of claim 1, wherein the resilient and elastic rubber-like material is a particulate rubber derived from recycled tires.

4. The system of claim 1, further comprising a plurality of shelf-like extensions extending around the periphery of the lower portion of the body, and spaced-apart intervals vertically.

5. The system of claim 1, wherein the elongate member is one of a length of rebar, or a length of tubing.

* * * * *